United States Patent [19]

Sleator

[11] Patent Number: 4,860,218

[45] Date of Patent: Aug. 22, 1989

[54] DISPLAY WITH WINDOWING CAPABILITY BY ADDRESSING

[76] Inventor: Michael Sleator, 2281 NW. Hoyt, Portland, Oreg. 97210

[21] Appl. No.: 777,345

[22] Filed: Sep. 18, 1985

[51] Int. Cl.[4] ..... G09G 1/00

[52] U.S. Cl. ..... 364/518; 364/521; 364/927.631; 364/900; 340/724; 340/747; 340/750

[58] Field of Search ..... 364/518, 521, 200 MS, 364/900 MS; 340/721, 724, 745, 747, 750

[56] References Cited

U.S. PATENT DOCUMENTS

| | | | |
|---|---|---|---|
| Re. 31,200 | 4/1983 | Sukonick et al. | 340/724 |
| 3,610,902 | 10/1971 | Rahenkamp | 364/200 |
| 4,016,362 | 4/1977 | Bristow et al. | 340/724 |
| 4,070,662 | 1/1978 | Narveson | 340/324 AD |
| 4,212,009 | 7/1980 | Adleman et al. | 340/728 |
| 4,386,410 | 5/1983 | Pandya et al. | 364/518 |
| 4,404,554 | 9/1983 | Tweedy, Jr. et al. | 340/750 |
| 4,412,294 | 10/1983 | Watts et al. | 364/518 |
| 4,437,093 | 3/1984 | Bradley | 340/747 |
| 4,484,192 | 11/1984 | Seitz et al. | 340/721 |
| 4,484,302 | 11/1984 | Cason et al. | 364/900 |
| 4,533,910 | 8/1985 | Sukonick et al. | 340/721 |
| 4,542,376 | 9/1985 | Bass et al. | 340/724 |
| 4,549,275 | 10/1985 | Sukonick | 364/521 |
| 4,555,775 | 11/1985 | Pike | 364/900 |
| 4,574,364 | 3/1986 | Tabata et al. | 364/900 |
| 4,598,384 | 7/1986 | Shaw et al. | 364/900 |
| 4,618,858 | 10/1986 | Belch | 340/724 |
| 4,618,859 | 10/1986 | Ikeda | 340/724 |
| 4,633,415 | 12/1986 | Vinh et al. | 340/747 |
| 4,642,790 | 2/1987 | Minshull et al. | 340/724 |
| 4,653,020 | 3/1987 | Cheselka et al. | 364/900 |
| 4,656,602 | 4/1987 | Berkland et al. | 364/900 |
| 4,663,735 | 5/1987 | Novak et al. | 364/900 |
| 4,694,392 | 9/1987 | Balland et al. | 364/200 |

*Primary Examiner*—Parshotam S. Lall
*Assistant Examiner*—Joseph L. Dixon
*Attorney, Agent, or Firm*—Krass & Young

[57] ABSTRACT

A method and apparatus for providing a computer display with windowing capability. Through the storage of a sequence of linked references to areas in a computer memory, each reference providing horizontal and vertical extent of a subregion of the intended displayed information, an apparatus for readily constructing the desired display results. There is no need for a dedicated display memory. The disclosure defines the subregions to be those which result when the horizontal raster-scan lines passing through the upper lefthand corner of each window are extended to the left and right margins of the display area. Vertical boundaries between the regions are defined by the edges of the windows themselves. A method for describing the location and horizontal and vertical extents of each subregion is also disclosed.

20 Claims, 4 Drawing Sheets

DISPLAY WITH WINDOWING CAPABILITY BY ADDRESSING

FIELD OF THE INVENTION

This invention relates to a method and apparatus for displaying information on a computer terminal and, more particularly, for providing a windowing capability for overlaying distinct sets of information on a computer display terminal.

DISCUSSION OF THE PRIOR ART

The abilities of computer display apparatus to effectively and efficiently provide information to the computer user are continually expanding. This expansion coincides with the increasing ability of computer systems to process data, especially those data which benefit from being displayed to the user, e.g., graphical and textual information.

Systems capable of simultaneously presenting distinct sets of data are useful in applications such as separately composing the textual and pictorial information to be incorporated into a paper and subsequently properly combining those two kinds of information to give the finished product. Another example of this so-called "windowing" capability is that of desk organization programs, which allow a user to handle electronic "copies" of various papers and memos, placing them in files, discarding them in "waste baskets" and bringing to the top of a desk a paper or report which the user wishes to deal with.

As the speed of the hardware which accomplishes these tasks increases with maturing technology, accomplishing such windowing tasks through the use of dedicated hardware becomes increasingly viable. The organization of such hardware, however, is generally quite inflexible with respect to the possible formats in which it can treat data. In order to preserve the increasing efficiency of such hardware systems, they must be dedicated to operate within prescribed, fixed constraints, such as (1) fixed window formats and locations, (2) specific data types which may be placed in certain windows, and (3) restricted operations which are possible within such windows.

Just as increasing computer speed has made possible the accomplishment of these windowing tasks by means of dedicated hardware, so also has this improved performance produced an increased speed in software solutions to these problems. However, the software solutions offer the advantage of greater flexibility. This flexibility can be used to remove many of the restrictions, mentioned above, to which the hardware approach to windowing is necessarily subject.

Typically, computer display systems contain a large main memory in which all of the data to be related are stored and a smaller image memory which is dedicated to containing the data which are to be displayed. These systems operate by transferring data from locations in the main memory to the image memory locations which correspond to their desired display locations. In a raster-scanning display system using an image memory, contiguous locations in the image memory are read and a corresponding raster-scan signal which ultimately produces the presented images on the display system is produced with respect to those contiguous image memory locations. The step of transferring data from the main memory to the image memory both increases the memory requirements of the display system and diminishes its performance by requiring the reading of the appropriate data from the main memory to the image memory.

A software approach to providing a windowing capability can be accomplished without requiring special hardware. The software approach is inherently flexible, yet increasing computer speeds allow these programs to accomplish windowing in satisfactory times. It will allow the nearly arbitrary placement of windows on the display screen as well as complete freedom of choice in the data to be displayed in any particular window. A computer display system implementing the software approach to windowing is therefore desirable.

SUMMARY OF THE INVENTION

The present invention utilizes the inherent flexibility of software together with a small amount of hardware to accomplish a windowing capability for a computer display system. As opposed to transferring data to be displayed from the main memory into an image memory, the software approach generates a list which controls the ultimate display location of the data, which are kept in the main memory. The list is generated by properly "linking" certain sublists, of which the entire list is composed.

The windowing capability of this invention is realized by properly subdividing the windows to be displayed, and designating their associated sublists. The locations of the four corners of each window to be displayed are known as well as which windows cover portions of which other windows.

The raster-scanning takes place in a left-to-right horizontal direction. Letting the vertical boundaries of these windows stand, subwindows are defined by extending the horizontal boundaries of the windows across the full horizontal extent of the graphics display device. In doing so, the software recognizes as "control points" the upper left corners of the subwindows just defined. Along with the locations of these control points, the software notes both the horizontal and vertical extent of these subwindows and the memory locations at which the data to be displayed in each subwindow begins. This information makes up each sublist, a sublist corresponding to a subwindow. In constructing the desired windowed display, the software switches appropriately from one sublist to another, feeding the data in the corresponding main memory locations to a raster-scan device which produces the desired visual display.

According to one aspect of this invention, an apparatus is provided for creating a raster-scanning signal, comprising a means for storing displayable data, means for producing a raster-scanning signal representing the contents of a sequence of locations in a storage means, means for storing data that control the sequence of accessing the contents of locations in a storage means, and control means for sequentially supplying addresses of locations in the displayable data storage means to the raster-scanning signal production means, where the sequence is specified by the contents of the control data storage means.

DETAIL DESCRIPTION OF THE PREFERRED EMBODIMENT

Figure 1:
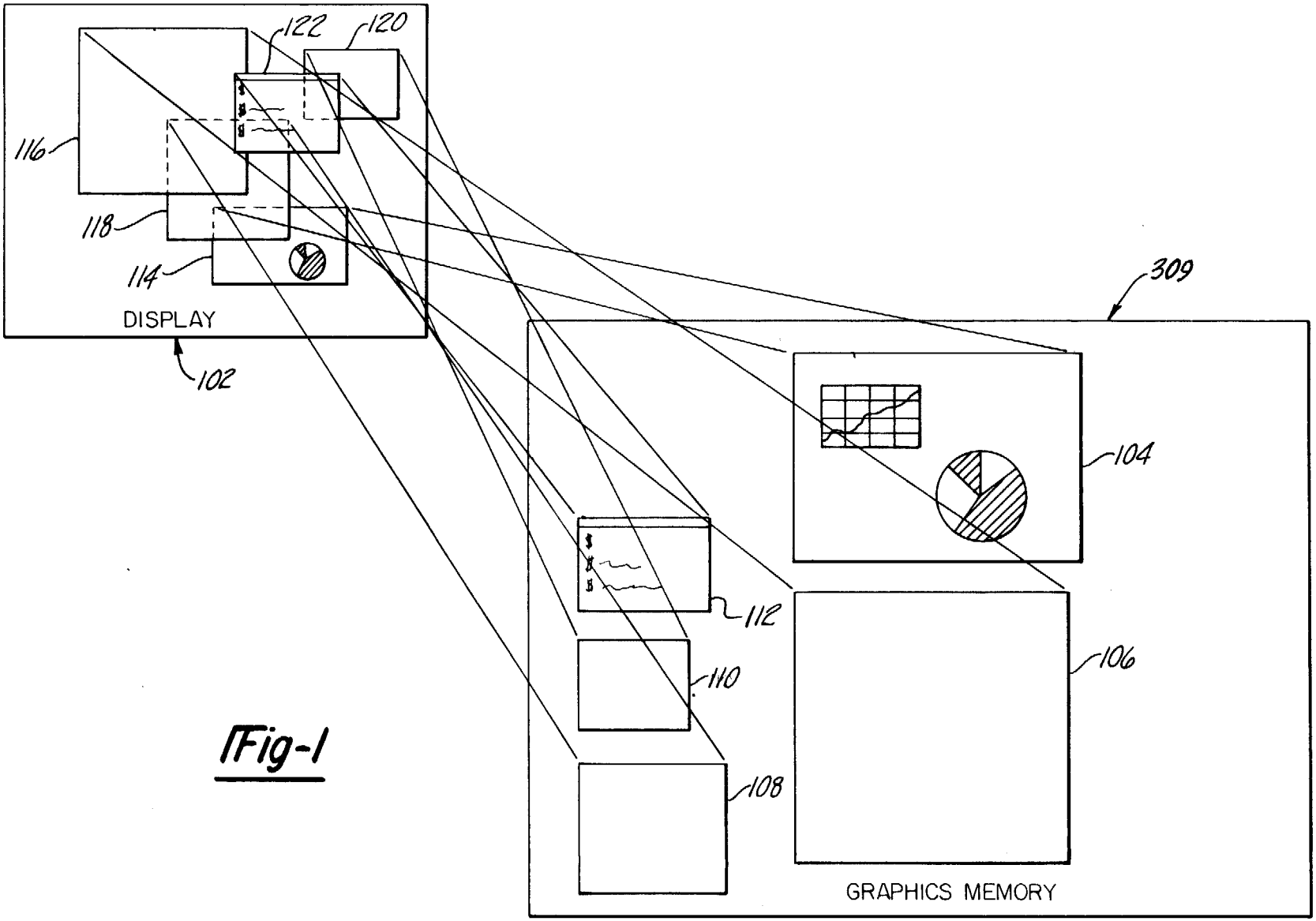
FIG. 1 is a diagrammatic representatation of the mapping from a graphic memory to the display screen.

Referring now to the drawings and, more particularly, to FIG. 1, an understanding of the concept of "windowing" may be obtained. FIG. 1 shows diagrammatically a computer graphic memory 309, which may actually consist of bit planes containing the information in parallel. Contained within the graphics memory 309 are data capable of being presented on the computer display screen 102 which may, for example, be a cathode ray tube (CRT). Among the data in the graphics memory 309 are rectangular regions 104–112, each comprising data to be treated as an entity. Depending upon the use being made of the data, the contained windows 104–112 may be displayed on the display device 102 much as overlapping sheets of paper. These displayed windows 114–122 can of course be overlapped in many ways. FIG. 1 shows the data in window 112, corresponding to the displayed region 122, as being on top. Region 114, corresponding to window 104, is shown to be on the bottom. This invention makes it readily possible to bring "to the top" any of the display regions through the simple method of appropriately changing references in a map memory. This method will be described at a later point in the disclosure.

Figure 2:
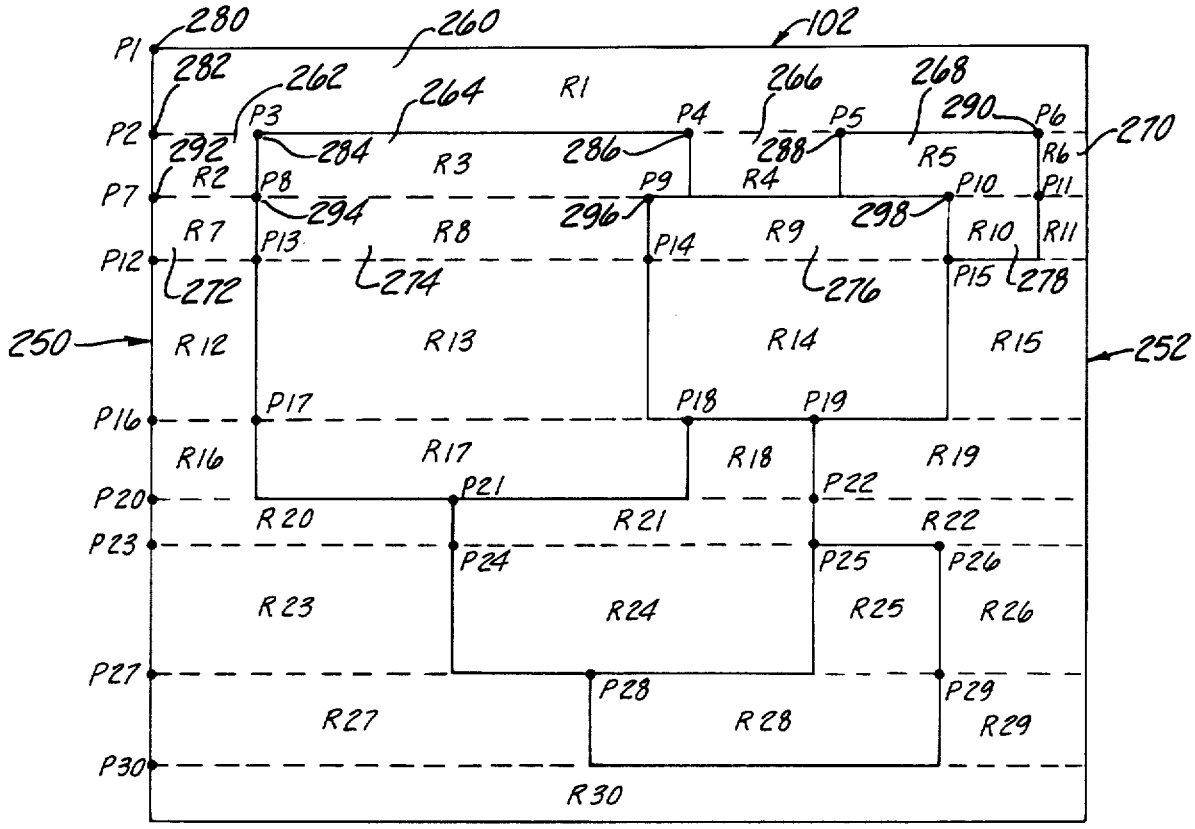
FIG. 2 is a representation of windowing on a display screen, defining control points and regions.

FIG. 2 shows a more detailed representation of the regions displayed on the display device 102 in FIG. 1. It further provides an easy description of the method for handling these regions. The display device 102 in FIG. 2 being a raster-scan device, it is convenient to subdivide the displayed regions into subregions along lines which represent a scanning direction of the display device 102. As shown in FIG. 2 scanning is done in the left-right direction. Subregions are defined by extending the horizontal lines defining the displayed top and bottom horizontal edges of each of the regions to the left and right margins (250 and 252, respectively).

This procedure clearly divides the entire area of display device 102 into rectangular subregions 260–278, and so forth. Corresponding to each of these regions 260–278 is a control point—the upper left corner (points 280–298) of each of the rectangular regions, respectively. It is clear that the decomposition of the area of the display device 102 may be completely characterized by designating the control points of all of the regions on the display device. Specifically, it is sufficient to know the relative horizontal and vertical extents of each region from its control point, the location of the data in graphics memory (100 in FIG. 1), and any "skip" factor which results from zooming a window to be displayed.

Figure 3:
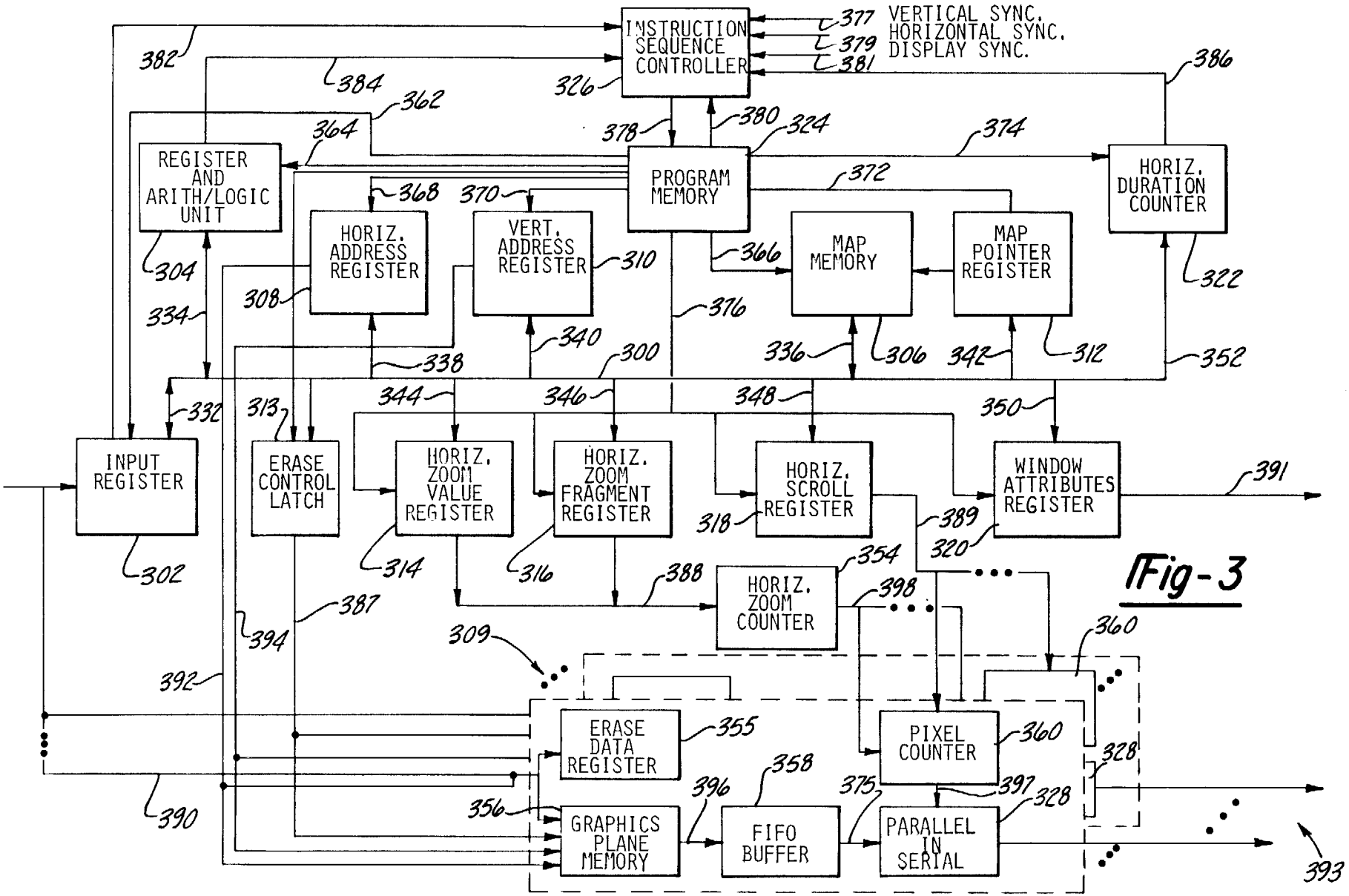
FIG. 3 is a block diagram of the window controller of the preferred embodiment.

FIG. 3 shows a detailed block diagram of the window controller, the electronic circuit which accomplishes the transformations from computer graphics memory 309 (FIG. 1) to display device 102 (also in FIG. 1). The window controller employs a data bus 300 which facilitates transfer of data among various subcomponents. Specifically, the input register 302, the Register and Arithmetic/Logic Unit (RALU) 304 and map memory 306 may either read or write data from or to the bus 300.

The other subcomponents attached to bus 300 may only read data from the bus. These devices are the horizontal address register 308, vertical address register 310, map pointer register 312, erase control latch 313, horizontal zoom value register 314, horizontal zoom fragment register 316, horizontal scroll register 318, window attributes register 320, and horizontal duration counter register 322. Devices 302–322 receive their data from bus 300 through paths 332–352, respectively. In addition devices 302–313 are controlled by program memory device 324 through paths 362–373, respectively. Horizontal duration counter register 322 is controlled by program memory device 324 through data path 374. Registers 314–320 are controlled by program memory device 324 through data path 376.

Program memory 324 communicates with instruction sequence controller 326 through paths 378 and 380. Instruction sequence controller 326 receives information from input register 302 and RALU 304 through data paths 382 and 384, respectively, and receives information from the horizontal duration control register 322 via path 386. Horizontal zoom counter 354 receives data from horizontal zoom value register 314 and horizontal zoom fragment register 316 via bus 388.

On each of the planes comprising the graphics memory 309 a graphics plane memory 356 receives graphic data, along with address and control signals, through external bus 390. Each copy of plane memory 356 is also accessed by erase control latch 313, erase data register 355, horizontal address register 308, and vertical address register 310 through paths 387, 389, 392, and 394, respectively. Graphics plane memory 356 communicates the data pointed to by latch 313 and registers 355, 308, 310, to a first-in first-out (FIFO) data buffer 358 over path 396. Depending upon values contained in the erase field of a control point entry, graphics plane memory 356 may be caused: (1) to display the data stored at the appropriate place in graphics plane memory 356, (2) to display the data placed in the erase data register while simultaneously writing these same data into the region of graphics plane memory 356 defined by the current control point (i.e., "erasing" the region), or (3) to perform as in 2 above, except causing certain bits of the graphics plane memory address to be ignored, thus erasing multiple images of the region throughout the graphics plane memory 356.

Horizontal zoom counter register 354 communicates with a pixel counter 360 on each plane through data path 398. FIFO buffer 358 and pixel counter 360 communicate with parallel-to-serial converter 328 through respective data paths 375 and 397.

Data path 391 carries window attribute data to the video section of the display device while data paths 393 carry the information generated by each plane of the graphics memory to the video sector. Data paths 377, 379 and 381 carry the vertical synchronization, horizontal synchronization and display synchronization signals from the display device.

Program memory device 324 is a read-only memory (ROM) containing the program which controls processing of the contents of the map memory 306. These instructions are encoded according to an instruction format, various encoded fields within the instruction specifying some particular register or operation. Program memory 324, therefore, also contains a "decoder" which accomplishes the connections from the program memory to the affected registers.

Map memory 306 is a read/write memory containing the window map being processed. This window map takes the form of a sequence of sublists, each sublist denoting the region associated with one or more control points as discussed in conjunction with FIG. 2. Included in the format of these sublists are pointers which accomplish jumping from one sublist to another, in accordance with the desired display. The format of the sublists will be discussed subsequently. Program memory 324 controls whether map memory 306 will be read from, written to, or disabled, in accordance with information passed to map memory 306 through control line 366. A particular point in the map memory 306 which will be affected is designated by map pointer register 312. The location in map memory selected by map pointer 312 can be either read from or written to, depending upon the signal sent along line 366. Line 336 is used to place the data needed for this reading or writing function.

The Register and Arithmetic/Logic Unit (RALU) 304 accomplishes a number of arithmetic and logical operations. Dependent upon decoded instructions received from program memory 324 over line 364, the RALU is configured to add or subtract 16-bit numbers (representing addresses, counter values, and the like) or perform various logic operations (OR, AND, AND Complement, Exclusive OR and Exclusive NOR, for example). The data to which these operations may be applied are contained within registers of the RALU 304 or received from the data bus 300 over bi-directional line 334. Where appropriate, the RALU 304 sends Carry and Zero result flags over line 384 to the instruction sequence controller 326, allowing program branching to be determined by the results of RALU operations.

Input register 302 holds data input to the window controller from external bus 390. These data are held in input register 302 until a request is sent from program memory 324 via line 362, requesting that the data be transferred to the data bus 300 via line 332. When the input register 302 is holding data awaiting transferral to data bus 300, it notifies instruction sequence controller 326 via signals sent over line 382. Data (and address and control signals) sent over external bus 390 may also be sent to graphics memory 309.

Horizontal duration counter register 322, when so instructed by data arriving from program memory 324 via line 374, reads, from the data bus 300, a count which measures the horizontal extent of the subregion presently being displayed on the display device. This reading event occurs when horizontal scan moves from one subregion to the next, causing a branch from the sublist control point entry corresponding to one control point to the next control point entry in the sublist. Thereafter, horizontal duration counter register 322 counts down and the corresponding parts of the raster-scan line is written, until the next subregion is reached. This is signified by the value in the horizontal duration counter reaching zero. When this happens, horizontal duration counter register 322 sends a signal on line 386 to the instruction sequence controller 326, signifying that the end of the horizontal extent of the present subregion has been reached.

Line 376, under the control of program memory 324, controls the loading of data from the data bus 300 into horizontal zoom value register 314, horizontal zoom fragment register 316, horizontal scroll register 318, and window atributes register 320. These data are contained in the sublist control point entry describing each control point in the displayed configuration.

The horizontal zoom value register 314 contains a value which indicates the number of consecutive times a given pixel is to be repeated, i.e., it contains the magnification factor. Horizontal zoom fragment register 316 is used to overcome any disjointed effects which may be produced on the display if two subregions are from the same window and that window is "zoomed." Register 316 counts the number of additional times to repeat the display of a particular pixel which has been displayed in a first subregion in order to achieve the desired zoom factor. Registers 314 and 316 work together to allow a zoom feature without causing fractures in the displayed image along boundaries of subregions. Through line 388, registers 314 and 316 control the horizontal zoom counter register 354 which correctly controls the repetition of a given pixel to accomplish the desired zoom effect.

Horizontal scroll register 318 contains the number of bits by which words addressed in the current subregions should be horizontally offset. Pixel counters 360, on each plane of the displayable memory, operate on data provided by horizontal zoom counter register 354 through line 398 and horizontal scroll register 318 through line 389. Pixel counters 360 are loaded from horizontal scroll register 318 at the start of each mapping row. Because pixel counter 360 provides the input to parallel-to-serial converter 328 through line 397, pixel counter 360 affects the horizontal scroll and zoom factors applied to the data read from the graphics plane memory 356.

Horizontal address register 308 contains the address, in graphics plane memory 356, of the first word of the current displayable horizontal segment of memory. This address is received from data bus 300 through line 338, under control of program memory 324 as accomplished through line 368. The vertical address register 310 contains the address in graphics plane memory 356, of the current pixel row in the currently active mapping region. This information is derived from the data bus 300 through line 340, under control of program memory 324 through line 370. The outputs of the horizontal address and vertical address register 308 and 310 are passed to the graphics plane memory 356, specifying the data which are to be written to the video device.

The data to be written are pointed to by the horizontal address register 308, through line 392 and the vertical address register 310, through line 394. They are read from graphics plane memory 356 and placed on line 396 to first-in, first-out buffer 358. The purpose of the first-in, first-out buffer 358 is to compensate for the limited speed of graphics plane memory 356, in order to provide a constant stream of data over line 378 to the parallel-serial converter 328. Parallel-serial converter 328 is a multiplexor which selects the bit of the word from the graphics plane memory 356 specified by the value from the pixel counter 360, and places that bit on line 393, the video output line. Window attributes register 320 holds data from the window attributes element related to the current control point, the data being sent via line 391 to the video display device, with the purpose of changing the attributes of the window currently being written.

Figure 4:
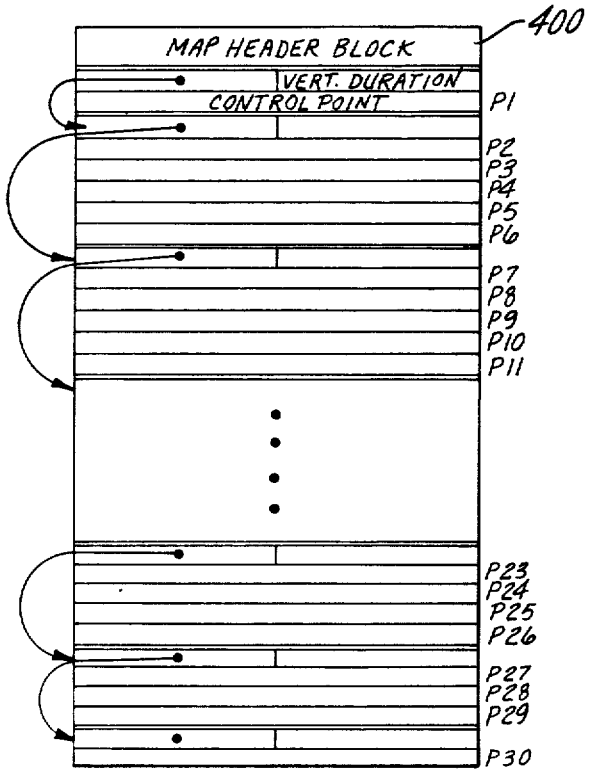
FIG. 4 is a schematic representation showing the data format of the window map.

Turning now to FIG. 4 of the drawings, the format of the data stored in window map memory 306 in FIG. 3 will be described. The contents of the window map are a map header block 400, followed by a series of sublists, one sublist per vertical duration interval. The map header block contains such information as (1) the active map address, indicating the beginning of the currently active window map, (2) the vertical address increment, indicating the increment to be added to the vertical address of each mapping region at the end of each scan line, and (3) the vertical interval count, showing the vertical extent of the vertical retrace interval.

Each of the sublists consists of a sublist header, containing a vertical duration count and a sublist link pointer. The header is followed by one or more control point entries. The vertical duration is the number of adjacent scan lines for which that sublist will be used. The sublist link pointer contains the address of the next sublist in window map memory 306. When the value in vertical duration counter in the sublist header is reduced to zero, processing resumes at the beginning of this next sublist.

Figure 5:
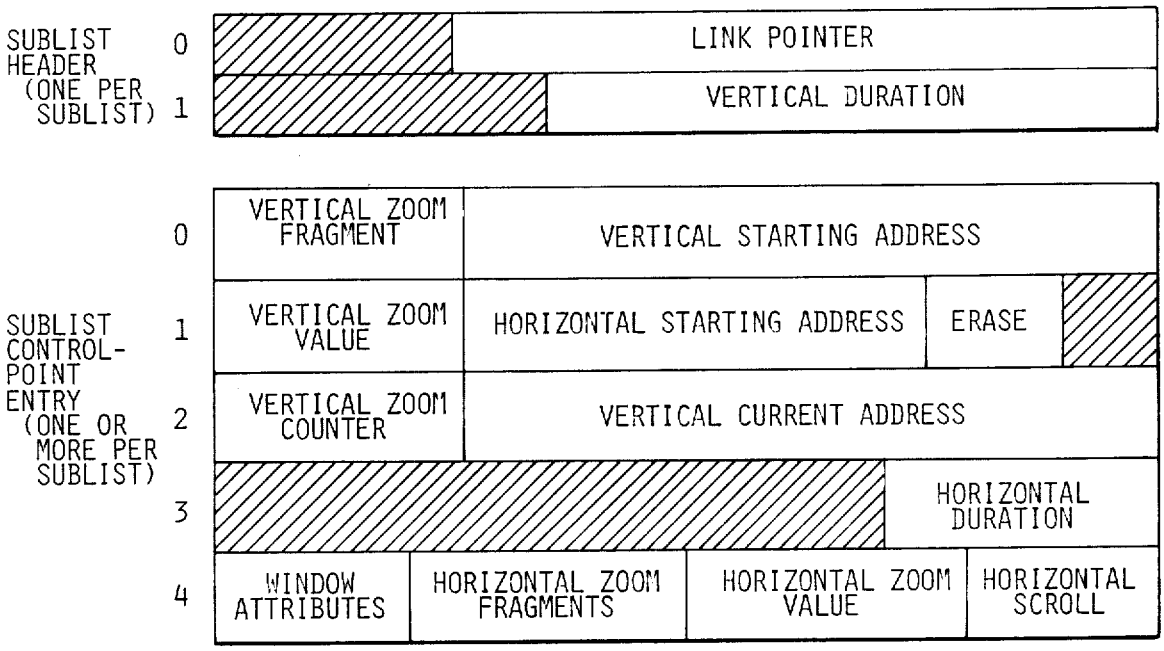
FIG. 5 is a schematic representation showing the detailed data format for a control point as shown in FIG. 4.

Referring now to FIG. 5 of the drawings, the format of a sublist may be seen in greater detail. In the preferred embodiment, the first datum provided is a sublist header containing, first, the 12 bit address of the header of the next sublist and, second, the 10 bit vertical duration, in scan lines, over which this sublist is to control what is to be displayed. These data are transferred to RALU 304. When the vertical duration register is reduced to zero, control is transferred to the next referenced sublist.

The next data are entries describing aspects of the subregion defined by a control point, each taking only 5 consecutive 16-bit words. The vertical zoom fragment (4 bits) and the vertical starting address (12 bits) are respectively used to control the number of repetitions of a horizontal scan line required because of a zoomed window continued from above the current subregion. The vertical zoom value and vertical zoom counters, four bit integers also controlling the repetition of scan lines, are found in the beginnings of the second and third words in the control point entry. All data controlling vertical address designation is fed to the RALU 304 which uses it to compute memory addresses to point to map memory 306.

Also contained in the second word of a control point entry is the horizontal starting address, which is used by the horizontal address register 308, and the two bit erase field, which controls the data written to or read from graphics plane memory 356.

Further modifications of the invention herein described will occur to persons skilled in the art and all such modifications are deemed to be within the spirit and scope of the invention as defined by the appended claims.

I claim:

1. A method for creating a raster-scanning signal for the display of overlapping rectangular fields of data, comprising the steps of:

storing displayable data in a memory means; storing sequential access control data that controls the sequence of accessing the displayable data stored in the memory means;

reading the stored sequential access control data; and creating a raster-scanning signal representative of the contents of a sequence of locations in the displayable data storage means, the sequence corresponding to the stored sequential access control data.

2. The method of claim 1, wherein the raster-scanning signal is further created in synchronism with external synchronization signals.

3. An apparatus for providing a raster-scanning signal for the display of overlapping rectangular fields of data, comprising:

displayable data storage means for storing displayable data;

means for producing a raster-scanning signal representing the contents of a sequence of locations in said displayable data storage means;

control data storage means for storing data that controls a sequence of accessing the contents of locations in said displayable data storage means; and control means for sequentially supplying, to said means for producing a raster-scanning signal, addresses of locations in said displayable data storage means, the sequence being specified by data stored in said control data storage means.

4. The apparatus of claim 3, wherein said displayable memory and control data memory are digital memories.

5. The apparatus of claim 4, wherein said displayable data storage means is comprised of a plurality of identical memories each provided the same location addresses by said control means.

6. The apparatus of claim 3, wherein said control means includes a programmed digital computer, including a digital memory.

7. The apparatus of claim 6, wherein said programmed digital computer is adapted to receive external synchronization signals.

8. An apparatus for creating a graphic display of data provided to it, comprising:

input means for receiving displayable input data;

displayable data storage means connected to said input means for storing displayable data;

means for producing a raster-scanning signal representing the contents of a sequence of locations in said displayable data storage means;

control data storage means for storing data that controls a sequence of accessing the contents of locations in said displayable data storage means; and control means for sequentially supplying, to said means for producing a raster-scanning signal, addresses of locations in said displayable data storage means, the sequence being specified by data stored in said control data storage means.

9. The apparatus of claim 8, wherein said displayable data storage means and control data storage means are digital memories.

10. The apparatus of claim 9, wherein said displayable data storage means comprises parallel digital memories.

11. The apparatus of claim 8, wherein said control means includes a programmed digital computer, with a digital memory.

12. The apparatus of claim 11, wherein said programmed computer is adapted to receive input synchronization signals.

13. The apparatus of claim 8, wherein said input data are comprised of displayable data and data for controlling the sequence of accessing stored data.

14. The apparatus of claim 13, wherein said control means is adapted to receive input synchronization signals.

15. An apparatus for providing a graphic display of data, comprising:

means for creating synchronization signals;

means for inputting input data, including displayable data;

displayable data storage means for storing said displayable data;

means for producing a raster-scanning signal representing the contents of a sequence of locations in said displayable data storage means;

control data storage means for storing data that controls a sequence of accessing the contents of locations in said displayable data storage means;

control means for sequentially supplying, to said means for producing a raster-scanning signal, addresses of locations in said displayable storage means, the sequence being specified by data stored in said control data storage means; and means for displaying the raster-scanning signal, adapted to receive said raster-scanning signal and said synchronization signals.

16. The display apparatus of claim 15, wherein said input data comprises displayable data and data for controlling the sequence of accessing stored data.

17. The apparatus of claim 16, wherein said displayable data storage means and said control data storage means are digital.

18. The apparatus of claim 17, wherein said displayable data storage means comprises parallel digital memories.

19. The apparatus of claim 18, wherein said control data can control the overlapped display of said display data upon said display means.

20. The apparatus of claim 19, wherein said control means includes means for supplying a sequence of repeated addresses of locations in said displayable data storage means, thereby producing an enlarged view of the data contained in said addresses.

* * * * *

UNITED STATES PATENT AND TRADEMARK OFFICE

CERTIFICATE OF CORRECTION

PATENT NO. : 4,860,218

DATED : Aug. 22, 1989

INVENTOR(S) : Michael Sleator

It is certified that error appears in the above-identified patent and that said Letters Patent is hereby corrected as shown below:

Column 8, line 54, "programmed computer" should be --programmed digital computer--.

Signed and Sealed this

Fourteenth Day of August, 1990

*Attest:*

HARRY F. MANBECK, JR.

*Attesting Officer*

*Commissioner of Patents and Trademarks*